US006137445A

United States Patent [19]

Ha et al.

[11] Patent Number: 6,137,445

[45] Date of Patent: Oct. 24, 2000

[54] ANTENNA APPARATUS FOR MOBILE TERMINAL

[75] Inventors: Dong-In Ha, Seoul; Ho-Soo Seo, Suwon; Alexandre Goudelev, Suwon; Konstantin Krylov, Suwon, all of Rep. of Korea

[73] Assignee: Samsung Electronics Co., Ltd., Rep. of Korea

[21] Appl. No.: 09/258,932

[22] Filed: Mar. 1, 1999

[30] Foreign Application Priority Data

Feb. 27, 1998 [KR] Rep. of Korea ..... 98-6504

[51] Int. Cl.[7] ..... H01Q 1/24

[52] U.S. Cl. ..... 343/702; 343/741; 343/866; 343/900

[58] Field of Search ..... 343/702, 741, 343/742, 866, 867, 900, 901

[56] References Cited

U.S. PATENT DOCUMENTS 4,814,776 3/1989 Caci et al. ..... 343/702
5,479,178 12/1995 Ha ..... 343/702
5,594,457 1/1997 Wingo ..... 343/702
5,764,191 6/1998 Tsuda ..... 343/702
5,818,392 10/1998 Oka et al. ..... 343/702

*Primary Examiner*—Tan Ho
*Attorney, Agent, or Firm*—Dilworth & Barrese

[57] ABSTRACT

An antenna apparatus for a mobile terminal is provided having a hula hoop antenna secured to a housing of the mobile terminal; a conductive line coupling the hula hoop antenna to a transceiver of the mobile terminal; a conductive fixing member having a through hole and contacting a portion of the hula hoop antenna; a cylindrical fixing member inserted into the through hole of the conductive fixing member; and a rod antenna extendable and retractable from and into the housing. The rod antenna is movable along a central axis of the cylindrical fixing member. The hula hoop antenna has a first end connected to a variable capacitor on a printed circuit board of the mobile terminal and a second end connected to a ground plate of the printed circuit board.

26 Claims, 16 Drawing Sheets

Retractable antenna on US PCS frequency
Azimuth plane, hula-hoop.
Ver. polarization, retracted position.

Tx pol: Horiz. Rx pol: Horiz.

Calibration status:
File: CALVHRN1.DAT
Chan.: 1710-1990M
Table: 1710-1990
Units: dBi Magnitude (db)
vs.
Azimuth (Deg.)

Overlays
Frequency: 1.850 GHz
Frequency: 1.880 GHz
Frequency: 1.910 GHz
Frequency: 1.930 GHz
Frequency: 1.960 GHz
Frequency: 1.990 GHz FR959
Automated Antenna
Measurement System Retractable antenna on US PCS frequency
Azimuth plane, matching circuit #4
Ver. polarization, retracted position.

Tx pol: Horiz. Rx pol: Horiz.

Calibration status:
File: CALVHRN1.DAT
Chan.: 1710–1990M
Table: 1710–1990
Units: dBi

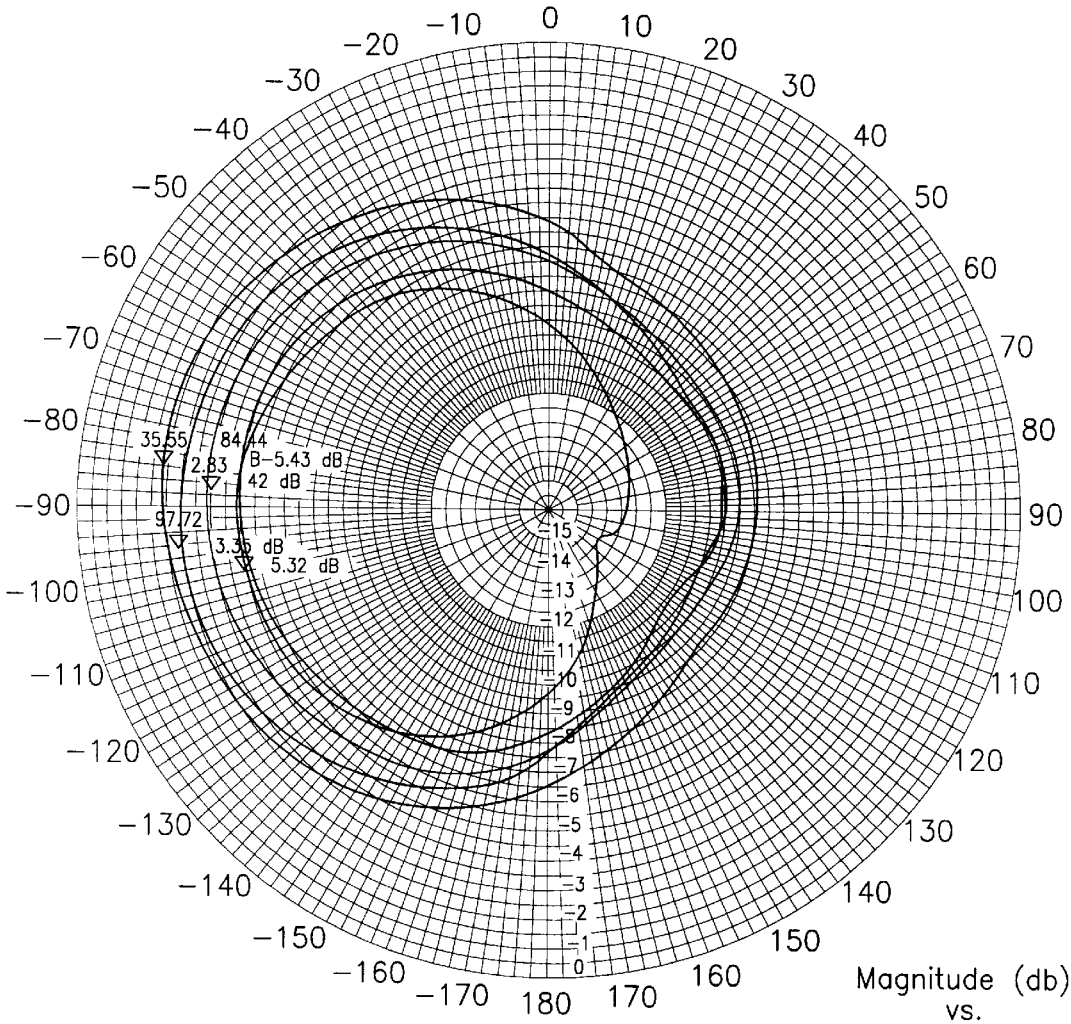

Magnitude (db)
vs.
Azimuth (Deg.)

Overlays
Frequency: 1.850 GHz
Frequency: 1.880 GHz
Frequency: 1.910 GHz
Frequency: 1.930 GHz
Frequency: 1.960 GHz
Frequency: 1.990 GHz FR959
Automated Antenna
Measurement System

*FIG. 12*

Hula-hoop antenna (80mm handset)-Ret. poz.
Hor. pol, Elevation plane.(H)

Tx pol: Horiz. Rx pol: Horiz.

Calibration status:
File: CALHHRN1.DAT
Chan.: 1710-1990M
Table: 1710-1990
Units: dBi Magnitude (db)
vs.
Azimuth (Deg.)

Overlays
Frequency: 1.750 GHz
Frequency: 1.805 GHz
Frequency: 1.850 GHz
Frequency: 1.870 GHz
Frequency: 1.890 GHz
Frequency: 1.910 GHz
Frequency: 1.960 GHz
Frequency: 1.990 GHz FR959
Automated Antenna
Measurement System Retractable antenna on US PCS frequency
Elevation plane, matching circuit #4
Hor. polarization, retracted position.

Tx pol: Horiz. Rx pol: Horiz.

Calibration status:
File: CALHHRN1.DAT
Chan.: 1710–1990M
Table: 1710–1990
Units: dBi

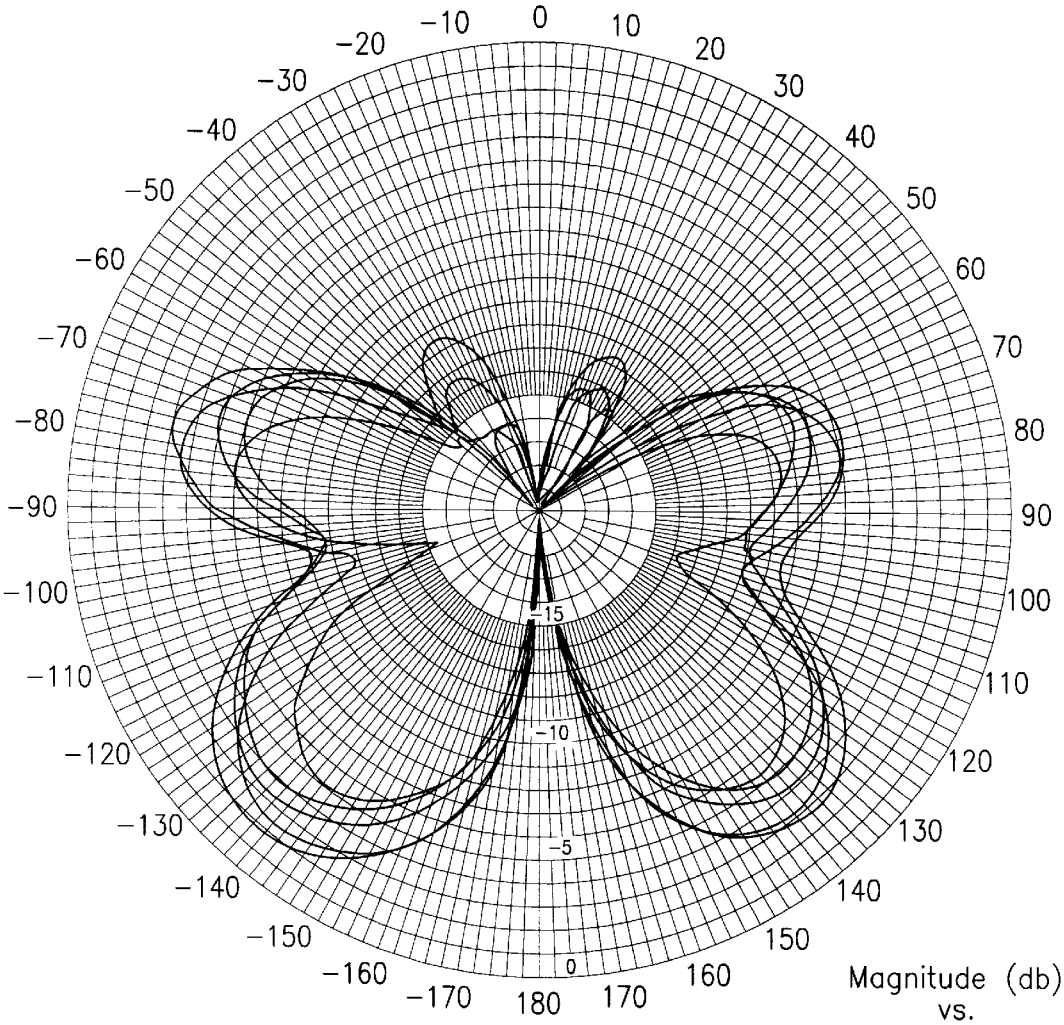

Magnitude (db)
vs.
Azimuth (Deg.)

Overlays
Frequency: 1.850 GHz
Frequency: 1.880 GHz
Frequency: 1.910 GHz
Frequency: 1.930 GHz
Frequency: 1.960 GHz
Frequency: 1.990 GHz FR959
Automated Antenna
Measurement System

*FIG. 14*

Retractable antenna on US PCS frequency
Azimuth plane, hula-hoop.
Ver. polarization, ext. position.

Tx pol: Horiz. Rx pol: Horiz.

Calibration status:
File: CALVHRN1.DAT
Chan.: 1710-1990M
Table: 1710-1990
Units: dBi Magnitude (db)
vs.
Azimuth (Deg.)

Overlays
Frequency: 1.850 GHz
Frequency: 1.880 GHz
Frequency: 1.910 GHz
Frequency: 1.930 GHz
Frequency: 1.960 GHz
Frequency: 1.990 GHz FR959
Automated Antenna
Measurement System Retractable antenna on US PCS frequency
Azimuth plane, matching circuit #4
Ver. polarization, extended position.

Calibration status:
File: CALVHRN1.DAT
Chan.: 1710–1990M
Table: 1710–1990
Units: dBi Tx pol: Horiz. Rx pol: Horiz.

Magnitude (db)
vs.
Azimuth (Deg.)

Overlays
Frequency: 1.850 GHz
Frequency: 1.880 GHz
Frequency: 1.910 GHz
Frequency: 1.930 GHz
Frequency: 1.960 GHz
Frequency: 1.990 GHz FR959
Automated Antenna
Measurement System Hula-Hoop antenna (80mm handset)-Ext. poz.
Hor. pol. Elevation plane (H)

Tx pol: Horiz. Rx pol: Horiz.

Calibration status:
File: CALHHRN1.DAT
Chan.: 1710-1990M
Table: 1710-1990
Units: dBi Magnitude (db)
vs.
Azimuth (Deg.)

Overlays
Frequency: 1.750 GHz
Frequency: 1.805 GHz
Frequency: 1.850 GHz
Frequency: 1.870 GHz
Frequency: 1.890 GHz
Frequency: 1.910 GHz
Frequency: 1.960 GHz
Frequency: 1.990 GHz FR959
Automated Antenna
Measurement System

ANTENNA APPARATUS FOR MOBILE TERMINAL

BACKGROUND

1. Field of the Invention

The present invention relates to an antenna apparatus for a mobile terminal and in particular, to an antenna apparatus for a mobile terminal where the antenna apparatus includes a hula hoop antenna and an extendable rod antenna for operating the antenna apparatus in an extended and in a retracted state.

2. Description of the Related Art

An antenna apparatus for a mobile terminal generally includes a fixed helical antenna and a retractable rod antenna. The helical antenna operates in a retracted state and the rod antenna operates in an extended state.

FIGS. 1 and 2 illustrate a prior art antenna apparatus having a rod antenna in the extended state and in the retracted state, respectively. A detailed discussion of the structure and operation of the antenna apparatus shown by FIGS. 1 and 2 can be found in Korean Patent Registration No. 107414/1996.

The antenna apparatus for a mobile terminal, as illustrated by FIGS. 1 and 2, includes a helical antenna 130 mounted on an upper portion of a housing 301, and a rod antenna 120 fixed to the housing 301 by an antenna cap 106. The hollow antenna cap 106 has a protrusion 107 formed at an upper, inner wall through which the rod antenna 120 is inserted. Under the antenna cap 106, a conductive female screw 111 is fixed to the upper end of the housing 301. A cylindrical male screw 109 having a through hole is screwed to the female screw 111. A head of the cylindrical male screw 109 is attached to a lower end of a helical winding 108 inserted into an opening of the antenna cap 106. The antenna cap 106 is fixed to the housing 301 such that a lower end of the antenna cap 106 is fixed to the head of the cylindrical male screw 109.

The rod antenna 120 is composed of a polyacetal rod 104, an antenna core line 105 inserted into the polyacetal rod 104, an isolation element 103 with a fixing groove 102 formed at an upper, outer circumference, and a pull 101 formed at an upper end of the isolation element 103. The rod antenna 120 is inserted into the antenna cap 106, passing along a central axis of the helical antenna 130 and the through hole of the cylindrical male screw 109. A lower end of the polyacetal rod 104 is fixed to a stopper 110.

In the retracted state of the rod antenna 120, the protrusion 107 formed at the upper portion of the antenna cap 106 is inserted into the fixing groove 102 of the isolation element 103 so that the rod antenna 120 may not extend out of the antenna cap 106 by itself. In the extended state of the rod antenna 120, the stopper 110 fixed to the lower end of the polyacetal rod 104 is stopped by a plate spring 112 mounted on the through hole of the cylindrical male screw 109. The female screw 111 is connected to a printed circuit board (PCB) 205 via a feeding connector 201.

With continued reference to FIGS. 1 and 2, the antenna core line 105 extends from the stopper 110 to the lower end of the isolation element 103. The polyacetal rod 104 has a good restoring force and serves as a protection rod for the antenna core line 105. The antenna core line 105 may be made of a silver-plated cooper wire or piano wire, or a super-elastic nickel-titanium wire (i.e., shape-memory alloy wire) having a good restoring force. An electric length of the antenna core line 105 measures between $\lambda/4$ and $\lambda/2$ (i.e., approximately 87–174 mm at 860 MHz), taking into consideration the vertical length of the housing 301. In practice, a physical length of the antenna core line 105 can be reduced to 132 mm by virtue of a dielectric constant indicative of the polyacetal rod 104. When the vertical length of the housing 301 is very short, a telescoping antenna may be used for the rod antenna 120.

The helical winding 108 of the helical antenna 130 is made of a silver-plated piano wire having a diameter of approximately 5.6 mm. An electric length of the helical winding 108 is related to the length of the antenna core line 105 of the rod antenna 120. A physical length of the helical antenna 130 is relatively much shorter than that of the rod antenna 120.

The antenna apparatus is positioned at one side of the mobile terminal, i.e., there is a positional asymmetry in the placement of the antenna apparatus with respect to the housing of the mobile terminal. In the extended state of the rod antenna 120, the positional asymmetry of the antenna apparatus, specifically, the positional asymmetry of the helical antenna 130 is non-problematic, since in the extended state, the overall length of the antenna apparatus is increased. Therefore, the distribution of radiation and the quality of communication is typically not affected.

However, in the retracted state of the rod antenna 120, the overall length of the antenna apparatus is reduced and only the helical antenna 130 radiates a radio signal. As a result, due to the positional asymmetry of the helical antenna 130, a radiation pattern indicative of the radiated radio signals is distorted, i.e., the radiation pattern is asymmetrical, thereby reducing the distribution of radiation in one or more directions. Hence, a receiving sensitivity may depend on the position of the mobile terminal.

Further, an increase in the operating frequency requires an extension in the size of the mobile terminal with respect to the wavelength which accelerates the distortion of the radiation pattern, thereby presenting a difficulty in designing a compact mobile terminal. To counteract this phenomenon, the length of the antenna apparatus can be increased. However, an increase in the length of the antenna apparatus presents a difficulty in designing a compact mobile terminal.

Therefore, a needs exists to provide a non-directional antenna apparatus for a mobile terminal which has a stable receiving sensitivity in the elevation and azimuth planes without compromising the compactness of the mobile terminal.

Further, a need exists to provide an antenna apparatus for a mobile terminal which has a symmetric radiation pattern in the retracted and extended states.

SUMMARY

The present invention provides an antenna apparatus for a mobile terminal having a hula hoop antenna secured to a housing of the mobile terminal; a conductive line coupling the hula hoop antenna to a transceiver of the mobile terminal; a conductive fixing member having a through hole and contacting a portion of the hula hoop antenna; a cylindrical fixing member inserted into the through hole of the conductive fixing member; and a rod antenna extendable and retractable from and into the housing. The rod antenna is movable along a central axis of the cylindrical fixing member. The hula hoop antenna has a first end connected to a variable capacitor on a printed circuit board of the mobile terminal and a second end connected to a ground plate of the printed circuit board.

BRIEF DESCRIPTION OF THE DRAWINGS

FIG. 12 is a graph illustrating a radiation pattern of the prior art antenna apparatus of FIG. 2 in the retracted state;

FIG. 14 is a graph illustrating a radiation pattern on the elevation plane of the prior art antenna apparatus of FIG. 2 in the retracted state;

DETAILED DESCRIPTION OF PREFERRED EMBODIMENTS

Figure 1:
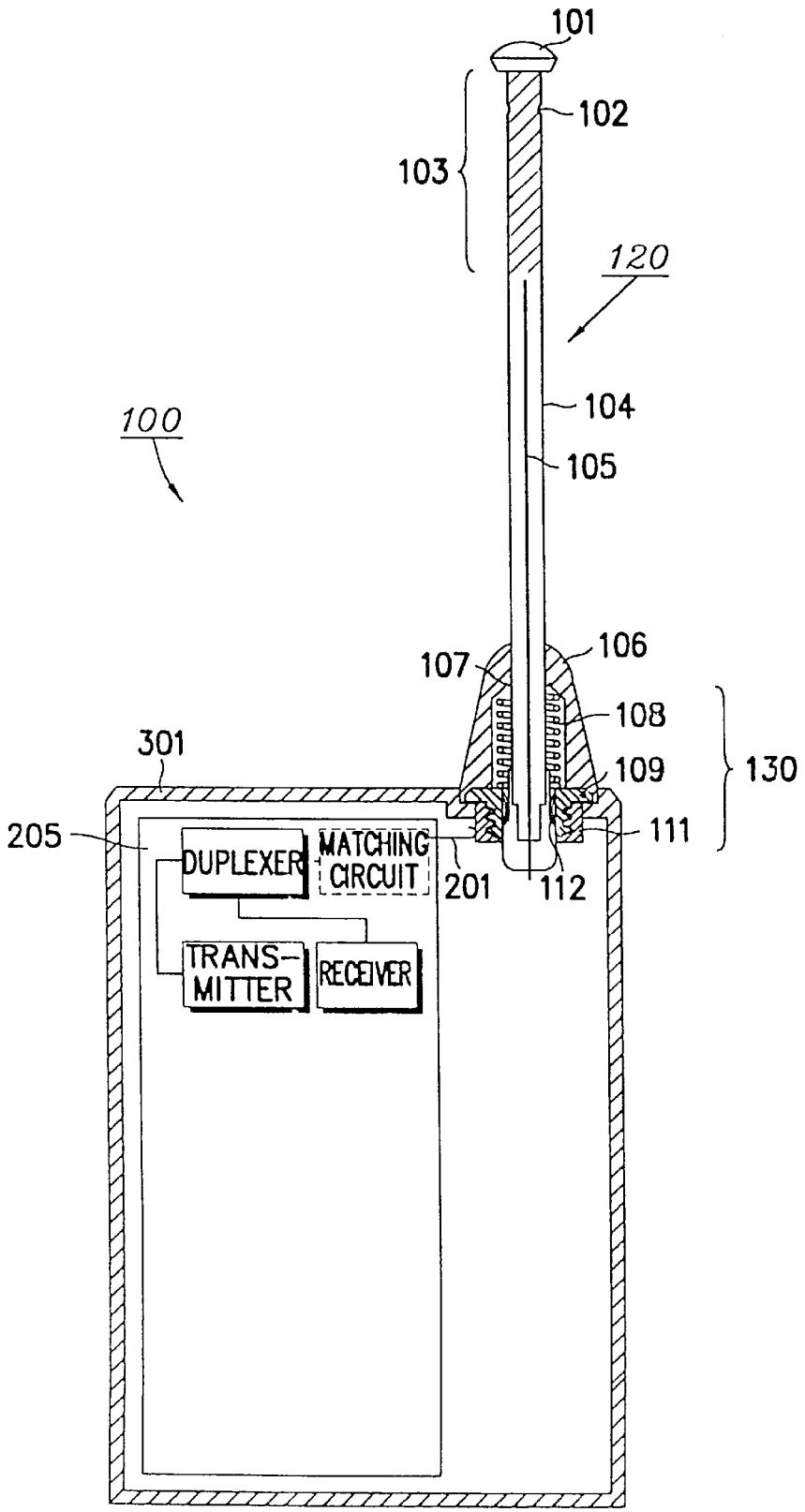
FIG. 1 (PRIOR ART)
FIG. 1 illustrates a prior art antenna apparatus in the extended state.

It is to be understood that in the following description of a preferred embodiment, specific details are set forth to provide a more thorough understanding of the present invention, notwithstanding that one skilled in the art may practice the invention without these specific details. It is to be further understood that in the accompanying drawings, similar reference numerals are used to denote elements having similar or equivalent constructions. In the following description, well known functions or constructions may not be described in detail since they would obscure the invention in unnecessary detail.

Figure 3:
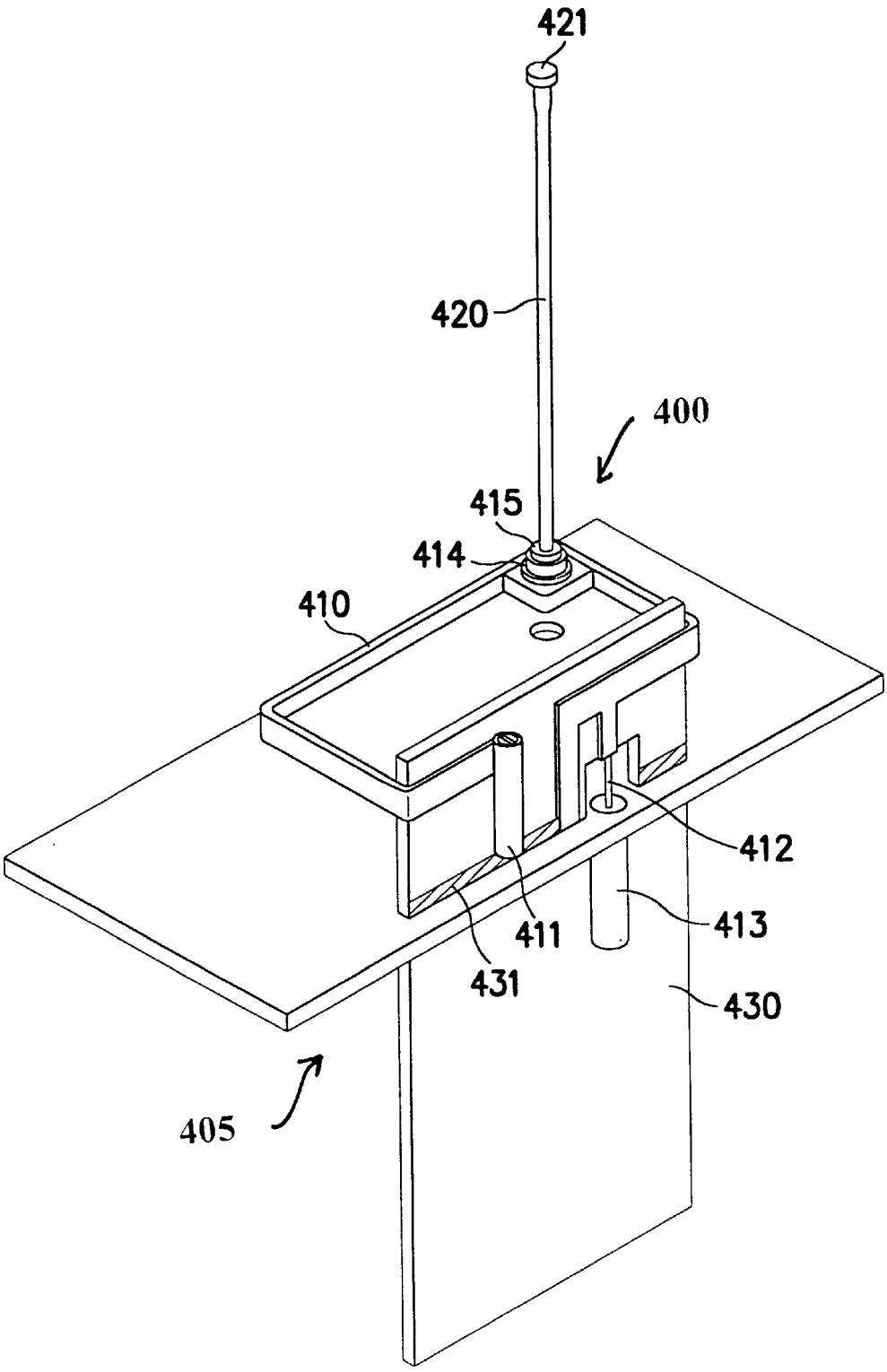
FIG. 3 illustrates an antenna apparatus for a mobile terminal in accordance with the present invention.
Figure 4:
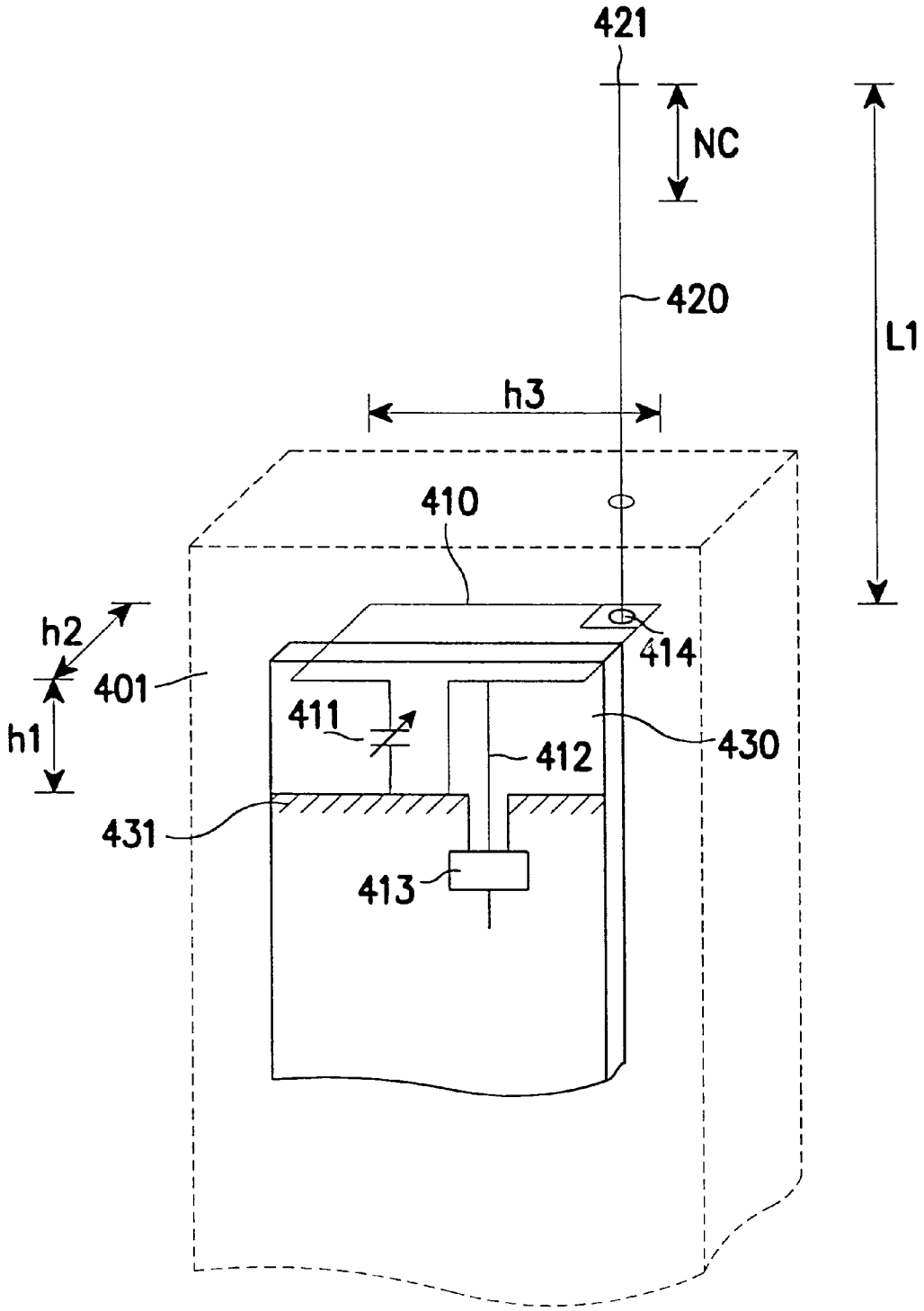
FIG. 4 illustrates the antenna apparatus of FIG. 3 in the extended state.
Figure 5:
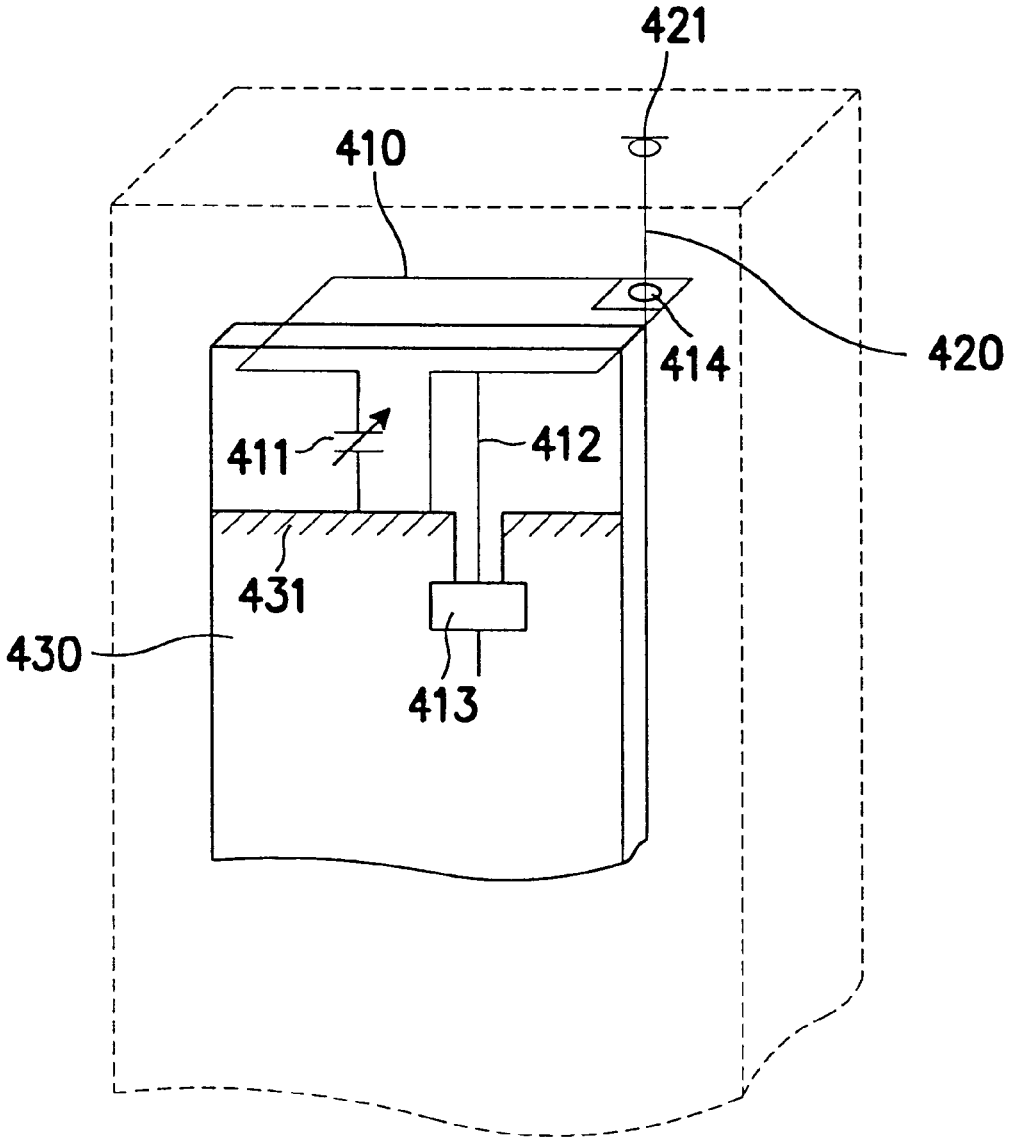
FIG. 5 illustrates the antenna apparatus of FIG. 3 in the retracted state.

FIG. 3 illustrates an antenna apparatus for a mobile terminal in accordance with the present invention designated generally by reference numeral 400. FIGS. 4 and 5 illustrate the antenna apparatus of FIG. 3 in the extended state and the retracted state, respectively.

With reference to FIGS. 3 to 5, the antenna apparatus 400 includes a rectangular hula hoop antenna 410 and a rod antenna 420. The hula hoop antenna 410 is placed at an upper, inner center of a housing 401 of a mobile terminal 405. The rod antenna 420, which is retractable and extendable into and from the housing 401 to change the state of the antenna apparatus 400, i.e., between the extended and retracted states, is disposed at a top right corner of the hula hoop antenna 410. The hula hoop antenna 410 is supported by a printed circuit board (PCB) 430.

The hula hoop antenna 410 has a first end connected to a variable capacitor 411 on the PCB 430 and a second end connected to a ground plate 431 of the PCB 430. The ground plate is removed at the upper portion of the PCB 430. A microstrip line 412 couples the hula hoop antenna 410 with a low noise amplifier (LNA) 413 of a transceiver (not shown). A conductive fixing member 414 having a through hole is fixed to a corner of the hula hoop antenna 410. A cylindrical fixing member 415 is inserted into the through hole of the conductive fixing member 414.

The rod antenna 420 is movably restricted to the housing 401 by the cylindrical fixing member 415. The rod antenna 420 includes a polyacetal rod, an isolation element with a length NC, and a pull button 421. The polyacetal rod has a conductive core line (not shown) formed along a central axis thereof. Lower ends of the conductive core line and the polyacetal rod are fixed to a stopper (not shown).

In the retracted state, a lower end of the rod antenna 420 reaches a retraction point (not shown) in the housing 401 as it passes through the cylindrical fixing member 415. In the extended state, the pull button 421 of the rod antenna 420 reaches a maximum extension point with respect to the housing 401 as the stopper fixed to the lower end of the polyacetal rod is stopped by the cylindrical fixing member 415.

The rod antenna 420 is manufactured from a metal wire and has a length L1, thereby emulating a $\lambda/2$ antenna in the extended state. The hula hoop antenna 410 is manufactured from a metal strip or wire. The rod antenna 420 is coated with a nonconductive material to prevent it from electrically coupling with the hula hoop antenna 410 while in the retracted state. Further, the rod antenna 420 is thick in order to contact the hula hoop antenna 410 and to prevent the rod antenna 420 from being pulled out from the cylindrical fixing member 415 while in the extended state.

In this antenna apparatus 400, a length ($2\times h2+2\times h3$) and a height h1 of the hula hoop antenna 410, and the variable capacitor 411 serve to improve the matching characteristic. Therefore, the antenna apparatus 400 does not require a separate matching circuit, since a radio signal is fed to the hula hoop antenna 410 via the microstrip line 412. Further, it is possible to obtain an input impedance of approximately 50 Ω by adjusting the height of the hula hoop antenna 410 or moving a feeding point right and left.

Figure 6:
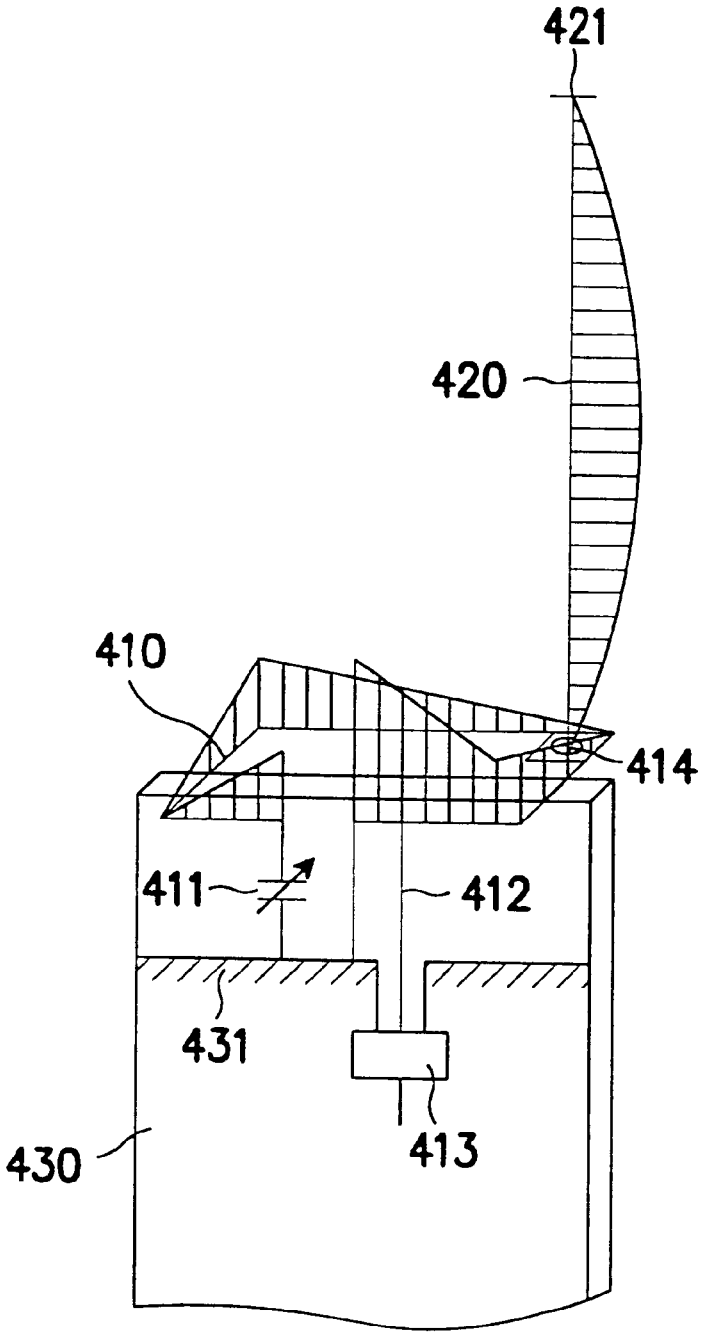
FIG. 6 illustrates a current distribution of the antenna apparatus of FIG. 3 in the extended state.

FIG. 6 illustrates a substantially symmetric current distribution of the antenna apparatus 400 in the extended state. For this symmetric current distribution, a radiation pattern on the azimuth plane is measured to be approximately circular. In the retracted stated, the rod antenna 420 is decoupled from the feeding point and only the hula hoop antenna 410 serves as a radiating element.

Referring back to FIGS. 3 to 5, the conductive fixing member 414 is placed at an upper, right corner of the hula hoop antenna 410, where the current distribution is relatively the lowest compared to other places. That is, the rod antenna 420 is placed at a given position of the hula hoop antenna 410 where the current distribution is relatively low.

Figure 7:
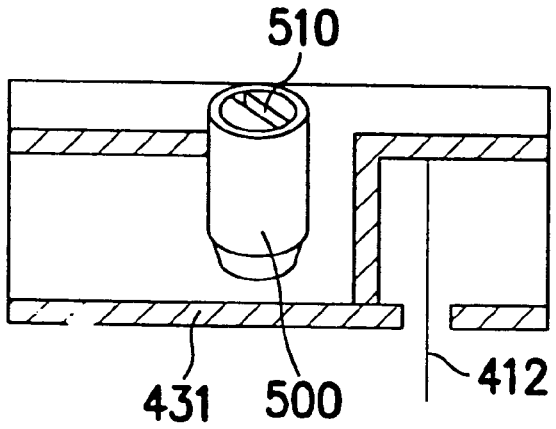
FIG. 7 illustrates a variable capacitor according to a first embodiment for the antenna apparatus of FIG. 3.

FIG. 7 illustrates the variable capacitor 411 according to a first embodiment of the present invention. As illustrated, the variable capacitor 411 is composed of a screwed cylinder 500 and a screw 510 inserted into the screwed cylinder 500. The capacitance of the variable capacitor 411 can be varied by screwing the screw 510 clockwise or counter-clockwise to move the screw 520 up or down, respectively.

Figure 8:
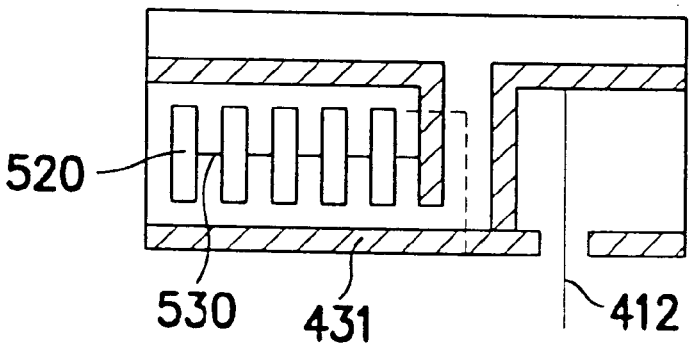
FIG. 8 illustrates a variable capacitor according to a second embodiment for the antenna apparatus of FIG. 3.

FIG. 8 illustrates the variable capacitor 411 according to a second embodiment of the present invention. As illustrated, the variable capacitor 411 is composed of a printed circuit board 431 having a plurality of patches 520. Each of the plurality of patches 520 is connected to an adjacent patch by a patch connection line 530. The capacitance of the variable capacitor 411 can be varied by cutting the patch connection line 530 at desired positions.

Figure 9:
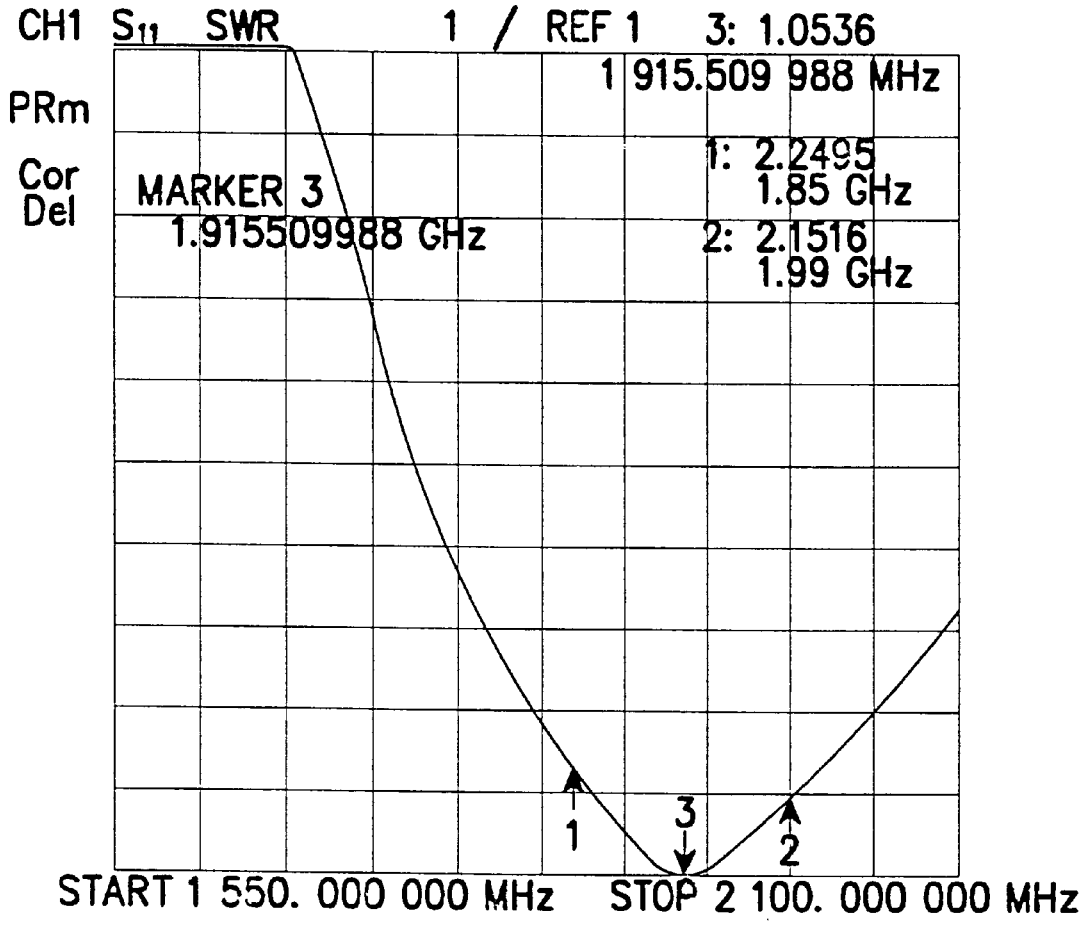
FIG. 9 is a graph illustrating a voltage standing wave ratio (VSWR) of the antenna apparatus of FIG. 5 in the retracted state.
Figure 10:
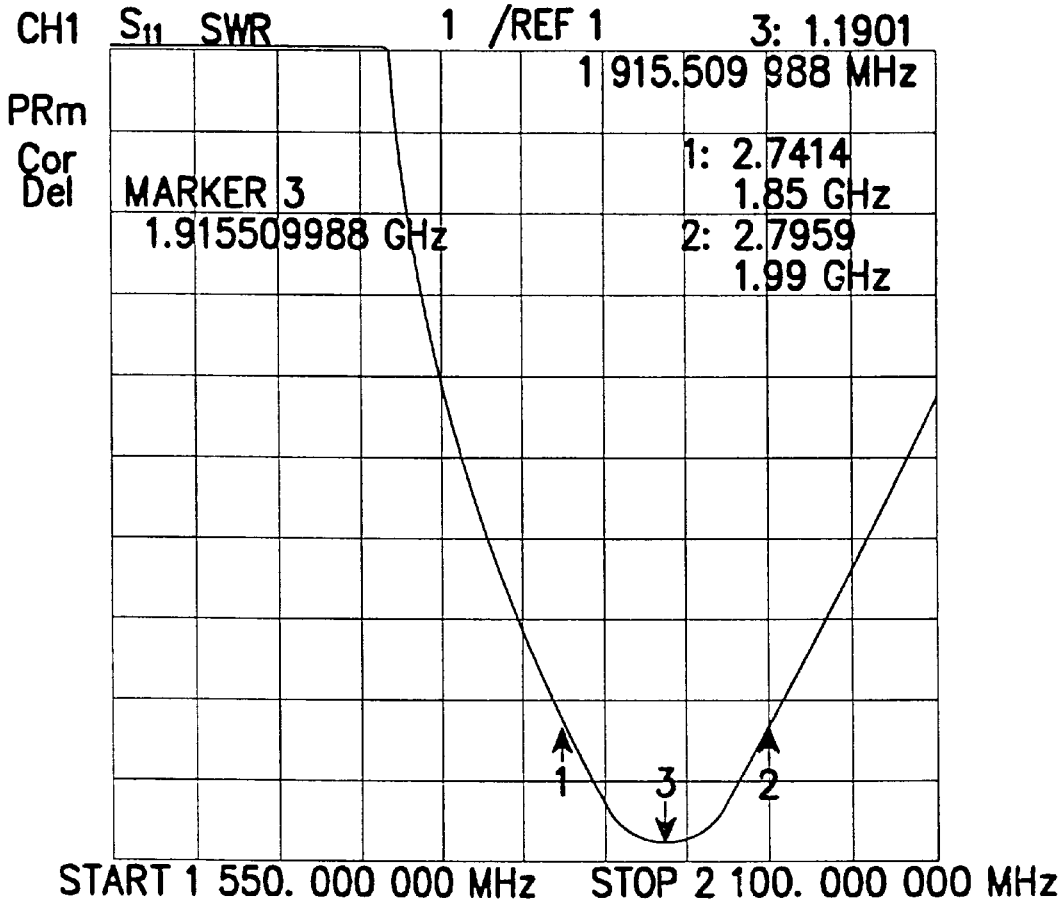
FIG. 10 is a graph illustrating a voltage standing wave ratio of the antenna apparatus of FIG. 4 in the extended state.

FIGS. 9 and 10 illustrate voltage standing wave ratios (VSWRs) of the antenna apparatus 400 in the retracted state and the extended state, respectively.

Figure 2:
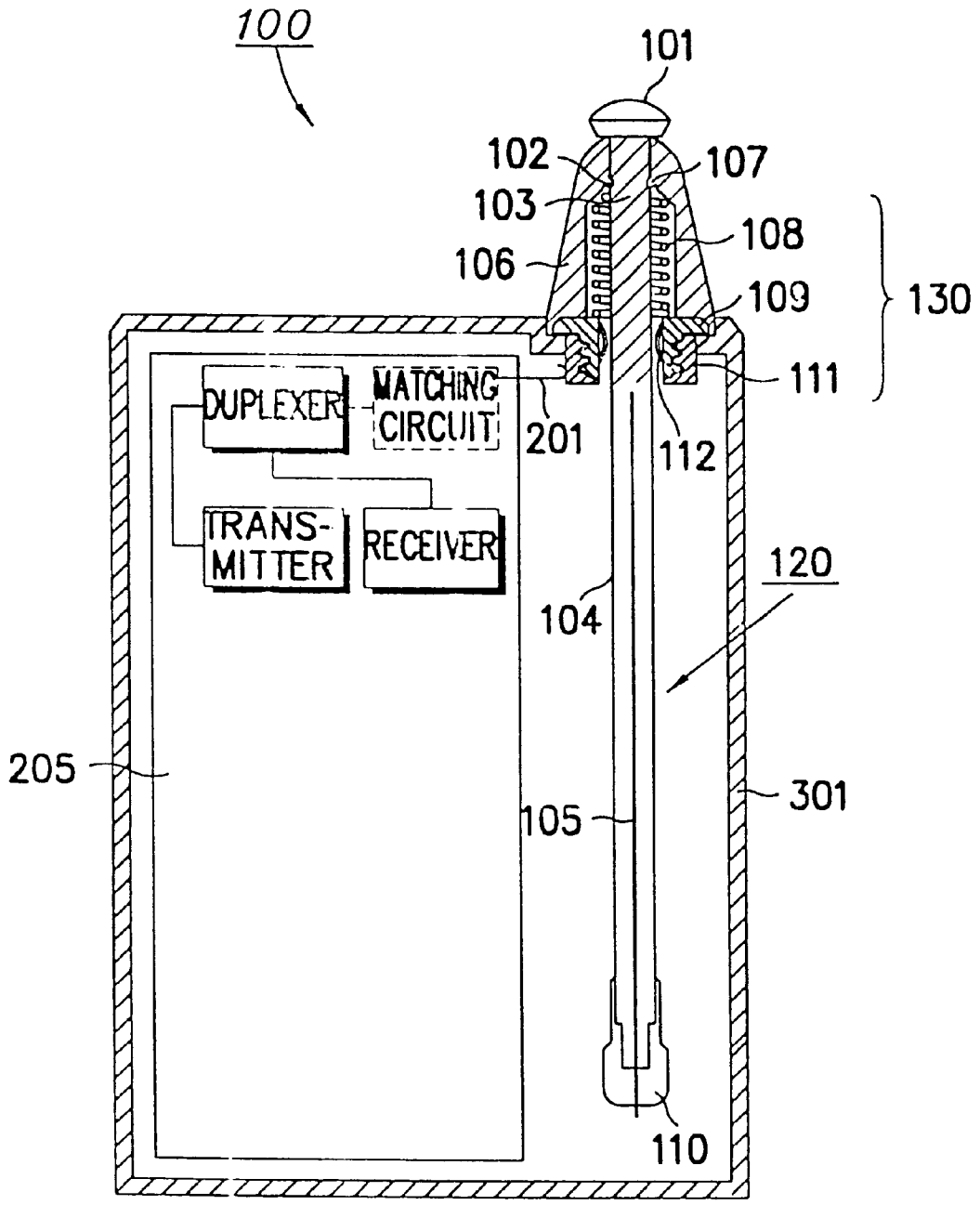
FIG. 2 (PRIOR ART)
FIG. 2 illustrates the prior art antenna apparatus of FIG. 1 in the retracted state.
Figure 11:
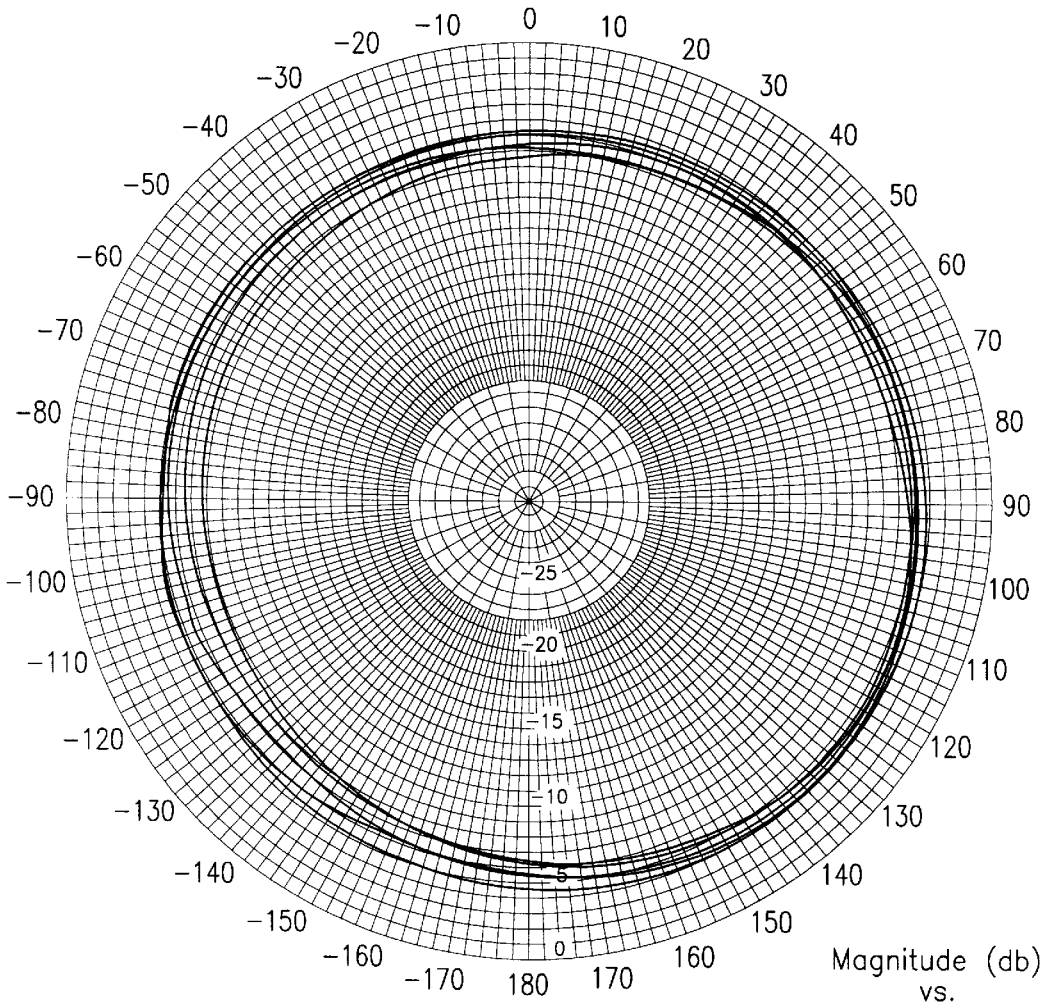
FIG. 11 is a graph illustrating a radiation pattern of the antenna apparatus of FIG. 5 in the retracted state.

FIG. 11 illustrates a radiation pattern of the antenna apparatus 400 on an azimuth plane in the retracted state, and FIG. 12 illustrates a radiation pattern of the prior art antenna apparatus 100 (FIG. 2) on the azimuth plane in the retracted state. For the antenna apparatus 400, a gain difference between the maximum and minimum gains on the azimuth plane is 9 dB. This is a much lower gain than that of the prior art antenna apparatus 100. A low gain difference decreases the directivity of the antenna apparatus 400, thereby improving the communication quality and providing a stable receiving sensitivity.

Figure 13:
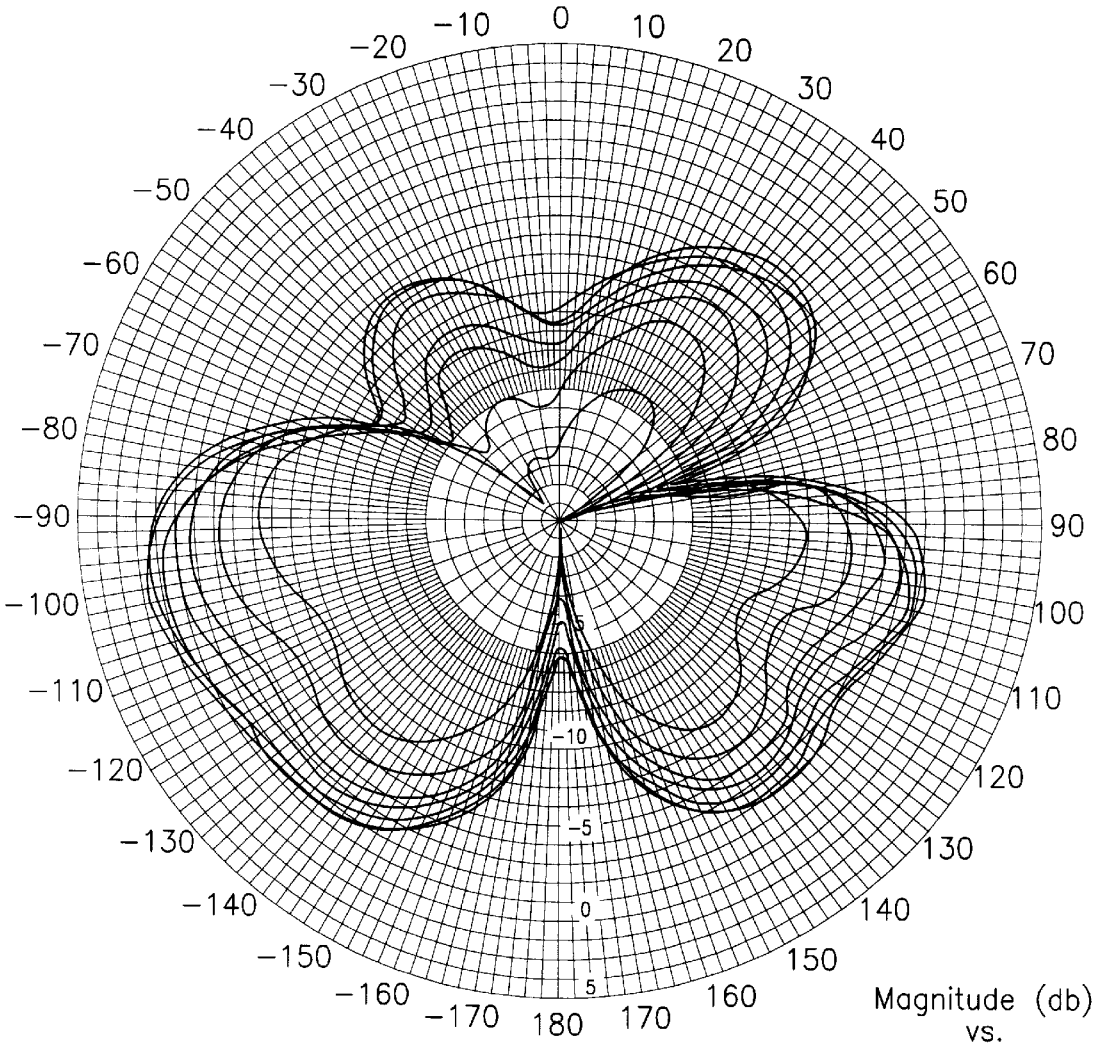
FIG. 13 is a graph illustrating a radiation pattern on an elevation plane of the antenna apparatus of FIG. 5 in the retracted state.

FIG. 13 illustrates a radiation pattern of the antenna apparatus 400 on an elevation plane in the retracted state, in which the peak gain appears at around 90°. The prior art antenna apparatus has a peak gain at around 140°, as shown by FIG. 14. Since the current distribution of the hula hoop antenna 410 is substantially symmetrical, the antenna apparatus 400 can maintain the symmetrical radiation pattern even in the retracted state of the antenna apparatus 400. In addition, since the rod antenna 420 is constructed to have a length $\lambda/2$ in the extended state, the increase in length of the antenna apparatus 400 increases the antenna gain and improves the communication quality.

Figure 15:
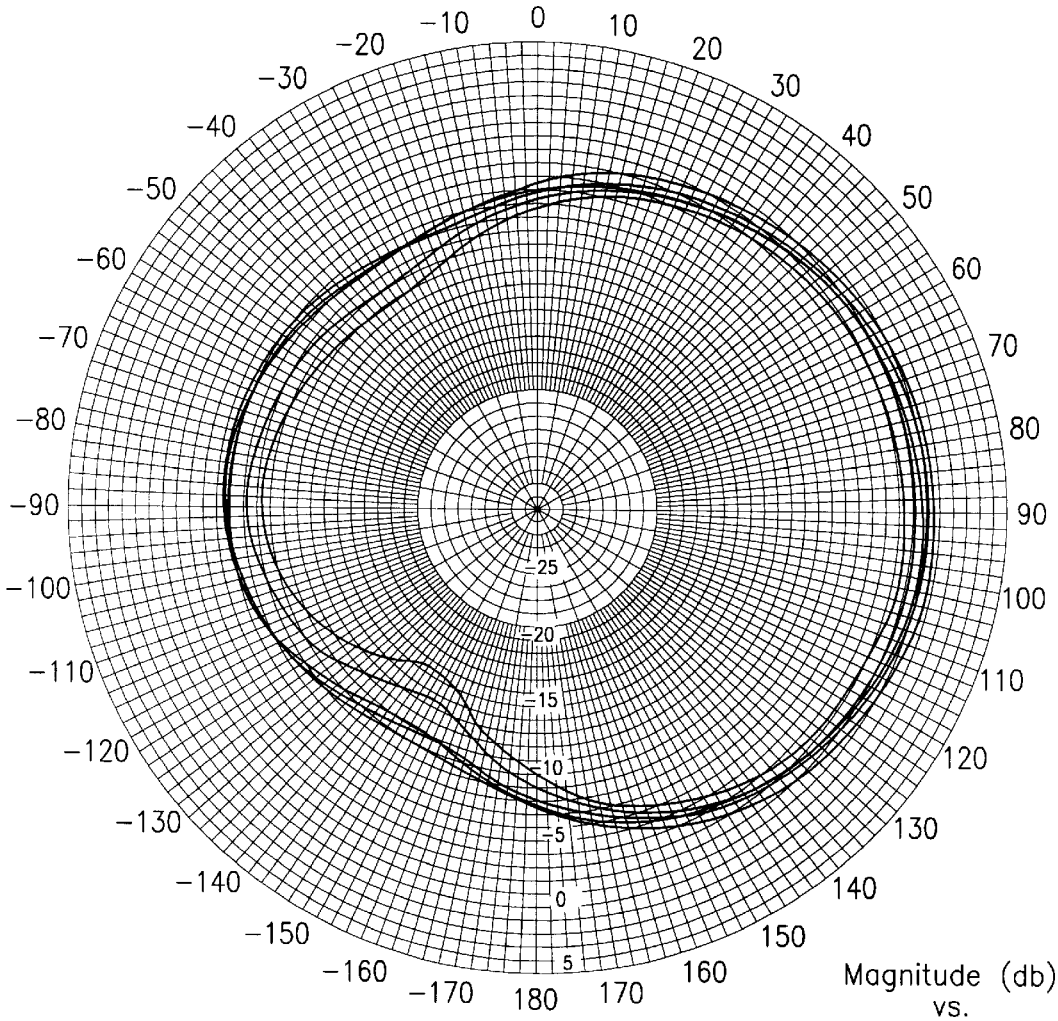
FIG. 15 is a graph illustrating a radiation pattern on the azimuth plane of the antenna apparatus of FIG. 4 in the extended state.
Figure 16:
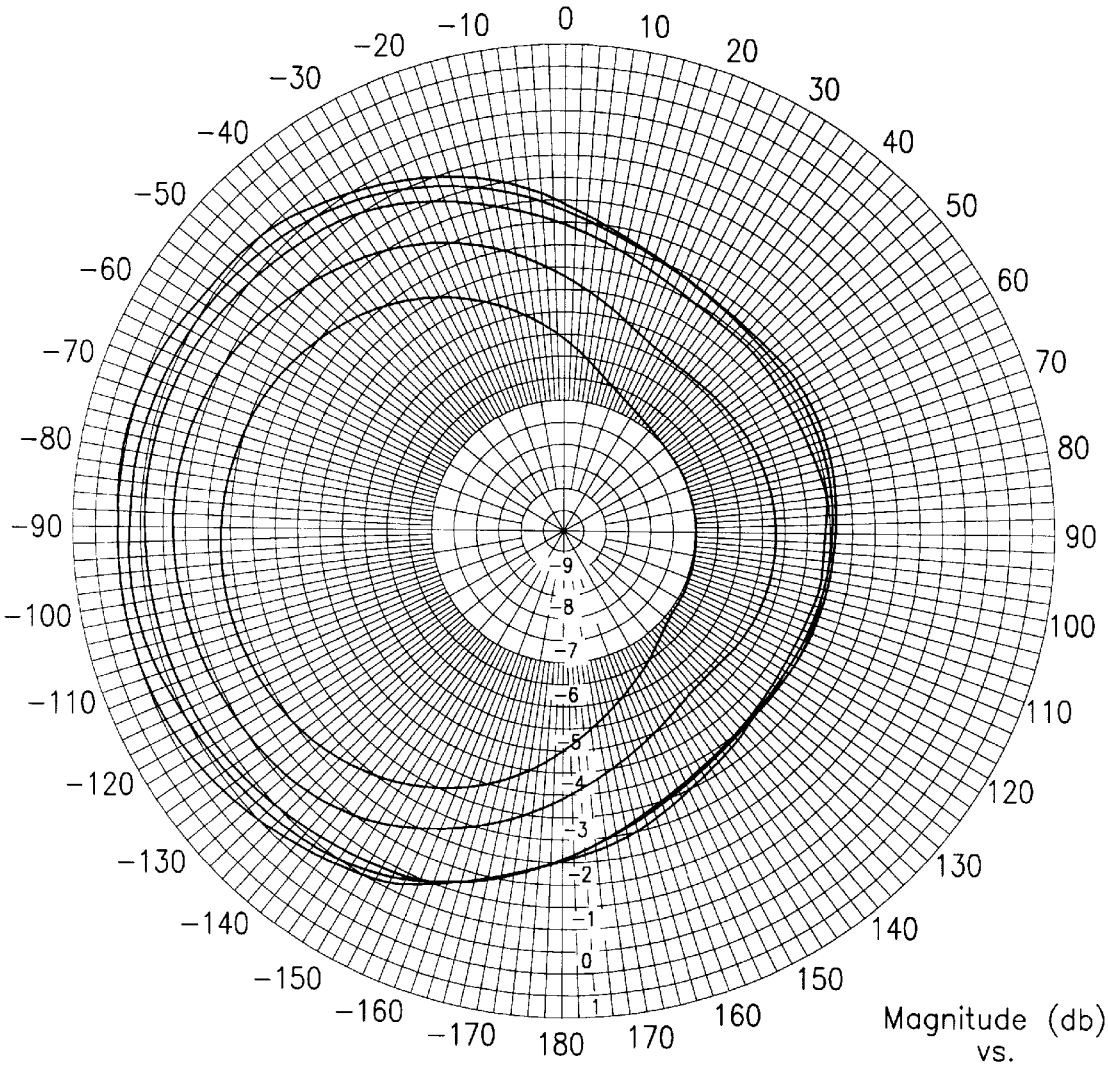
FIG. 16 is a graph illustrating a radiation pattern on the azimuth plane of the prior art antenna apparatus of FIG. 1 in the extended state.
Figure 17:
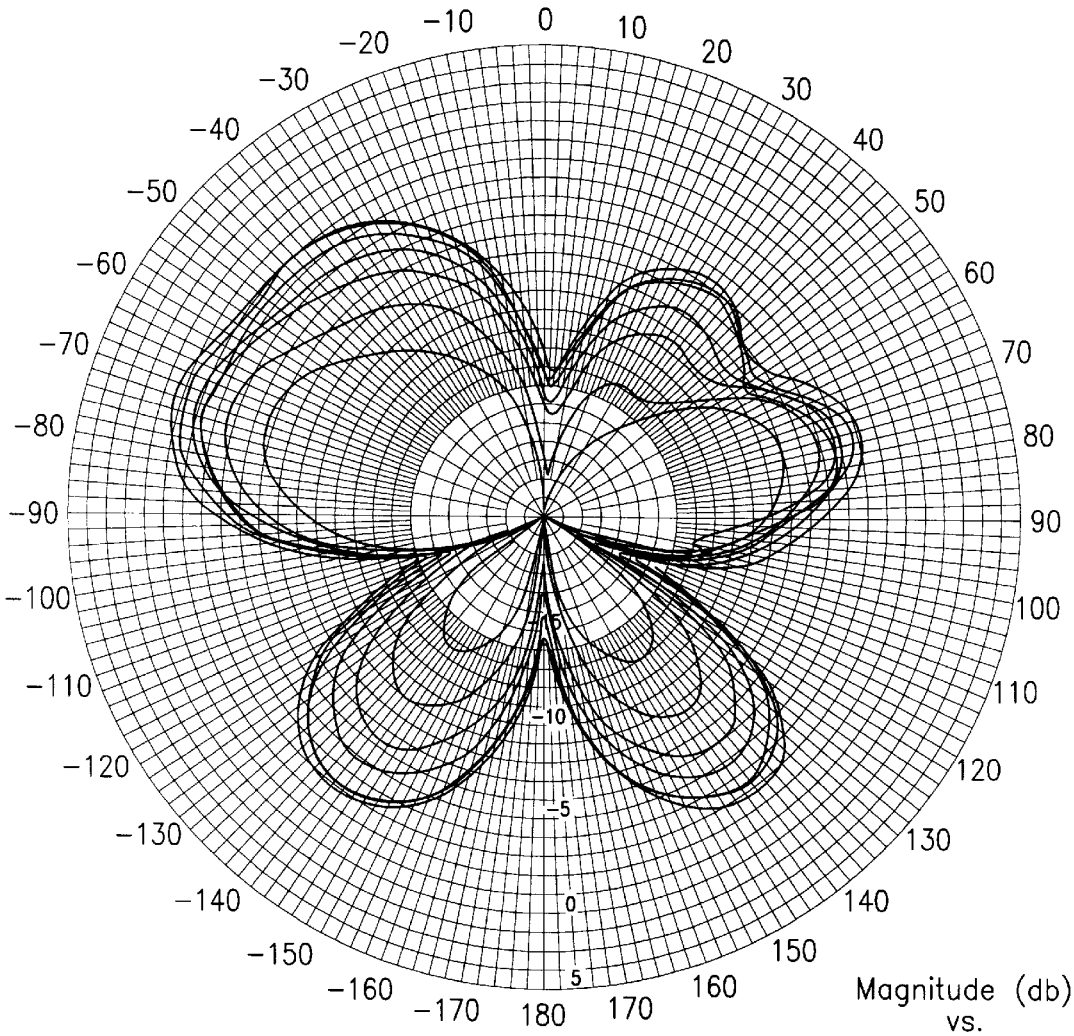
FIG. 17 is a graph illustrating a radiation pattern on the elevation plane of the antenna apparatus of FIG. 4 in the extended state.

FIG. 15 illustrates a radiation pattern of the antenna apparatus 400 on the azimuth plane in the extended state in which the gain difference between the maximum and minimum gains is 5 dB. The prior art antenna apparatus has a gain difference of 8 dB, as shown by FIG. 16, which is higher by 3 dB than the gain difference of the antenna apparatus 400. FIG. 17 illustrates a radiation pattern of the antenna apparatus 400 on the elevation plane in the extended state in which the peak gain appears at around 0–90°.

In conclusion, the antenna apparatus 400 has a stable receiving sensitivity and non-directivity by securing a symmetrical radiation pattern. When the present antenna apparatus 400 is used in a PCS (Personal Communication Service) band, it is possible to prevent the asymmetry of the radiation pattern, thereby improving the communication quality.

Although an illustrative embodiment of the present invention has been described herein with reference to the accompanying drawings, it is to be understood that the invention is not limited to that precise embodiment, and that various other changes and modifications may be affected therein by one skilled in the art without departing from the scope or spirit of the invention. All such changes and modifications are intended to be included within the scope of the invention as defined by the appended claims.

What is claimed is:

1. An antenna apparatus for a mobile terminal, comprising:

a hula hoop antenna secured to a housing of the mobile terminal;

a conductive line coupling the hula hoop antenna to a transceiver of the mobile terminal;

a conductive fixing member having a through hole and contacting a portion of the hula hoop antenna;

a cylindrical fixing member inserted into the through hole of the conductive fixing member; and a rod antenna extendable and retractable from and into the housing, said rod antenna movable along a central axis of the cylindrical fixing member.

2. The antenna apparatus according to claim 1, wherein the hula hoop antenna has a first end connected to a variable capacitor on a printed circuit board of the mobile terminal and a second end connected to a ground plate of the printed circuit board.

3. The antenna apparatus according to claim 1, wherein the hula hoop antenna is rectangular-shaped.

4. The antenna apparatus according to claim 1, wherein the rod antenna includes a polyacetal rod.

5. The antenna apparatus according to claim 1, wherein an outer surface of the rod antenna is coated with a nonconductive material.

6. An antenna apparatus for a mobile terminal, comprising:

a first antenna having a first end connected to a variable capacitor on a printed circuit board of the mobile terminal and a second end connected to a ground plate of the printed circuit board, said first antenna being secured to a housing of the mobile terminal;

a second antenna extendable and retractable from and into the housing;

a conductive line coupling the first antenna to a transceiver of the mobile terminal;

a conductive fixing member having a through hole and contacting a portion of the first antenna; and a cylindrical fixing member inserted into the through hole of the conductive fixing member, said second antenna passing through a central axis of the cylindrical fixing member for securing the second antenna to the housing.

7. The antenna apparatus according to claim 6, wherein the first antenna is a hula hoop antenna made from a metal wire.

8. The antenna apparatus according to claim 6, wherein the conductive fixing member is fixed to the first antenna at a position which causes a substantially low current distribution to be propagated by the antenna.

9. The antenna apparatus according to claim 6, wherein the second antenna is a rod antenna made of a wire and coated with a nonconductive material to prevent electrical coupling of the second antenna with the first antenna.

10. The antenna apparatus according to claim 6, wherein the second antenna has a length $\lambda/2$.

11. The antenna apparatus according to claim 6, wherein the second antenna is sufficiently thick to contact the first antenna in the extended state.

12. The antenna apparatus according to claim 6, wherein the second antenna is configured to be electrically decoupled from the first antenna when the second antenna is retracted within the housing, wherein only the first antenna serves as a radiating element.

13. The antenna apparatus according to claim 6, wherein the variable capacitor comprises:

a screwed cylinder; and a screw inserted into the screwed cylinder, wherein a capacitance of the variable capacitor can be varied by rotating the screw.

14. The antenna apparatus according to claim 6, wherein the variable capacitor comprises:

a printed circuit board;

a plurality of patches formed on the printed circuit board; and a patch connection line for connecting the patches, wherein a capacitance of the variable capacitor can be varied by cutting the patch connection line at given positions.

15. The antenna apparatus according to claim 6, wherein the first and second antenna operate in a PCS (Personal Communication Service) band.

16. The antenna apparatus according to claim 6, wherein a current distribution propagated by the antenna apparatus on an azimuth plane is substantially symmetrical when the second antenna is retracted within the housing.

17. The antenna apparatus according to claim 6, wherein a gain difference of the antenna apparatus between maximum and minimum gains on an azimuth plane is approximately 9 dB when the second antenna is retracted within the housing.

18. The antenna apparatus according to claim 6, wherein a peak gain of the antenna apparatus occurs at approximately 90° on an elevation plane when the second antenna is extended from the housing.

19. The antenna apparatus according to claim 6, wherein a gain difference of the antenna apparatus between maximum and minimum gains on an azimuth plane is approximately 5 dB when the second antenna is extended from the housing.

20. An antenna apparatus for a mobile terminal, comprising:

a hoop antenna having a rectangular shape secured to a housing of a mobile terminal;

a second antenna being extendable and retractable from and into the housing;

a conductive line coupling the hoop antenna to a transceiver of the mobile terminal;

a conductive fixing member having a through hole and contacting a portion of the hoop antenna; and a cylindrical fixing member inserted into the through hole of the conductive fixing member and having a bore therethrough configured to allow the second antenna to pass therethrough.

21. The antenna apparatus according to claim 20, wherein the hoop antenna has a first end connected to a variable capacitor on a printed circuit board of the mobile terminal, and a second end connected to a ground plate of the printed circuit board.

22. The antenna apparatus according to claim 21, wherein the variable capacitor comprises:

a screwed cylinder; and a screw inserted into the screwed cylinder, wherein a capacitance of the variable capacitor can be varied by rotating the screw.

23. The antenna apparatus according to claim 21, wherein the variable capacitor comprises:

a printed circuit board;

a plurality of patches formed on the printed circuit board; and a patch connection line for connecting the adjacent patches, wherein a capacitance of the variable capacitor can be varied by cutting the patch connection line at a certain position.

24. The antenna apparatus according to claim 20, wherein the second antenna is a rod antenna having a length $\lambda/2$ and coated with a non conductive material to prevent electrical coupling with the hoop antenna.

25. The antenna apparatus according to claim 20, wherein the second antenna is electrically decoupled from the hoop antenna when the second antenna is retracted within the housing, wherein only the hoop antenna serves as a radiating element.

26. The antenna apparatus according to claim 20, wherein an input impedance of the hoop antenna depends on the height thereof.

* * * * *